United States Patent [19]

Diekmann et al.

[11] 4,394,840

[45] Jul. 26, 1983

[54] WORKPIECE GUIDE FOR AUTOMATIC SEWING MACHINE

[75] Inventors: Herbert Diekmann, Vlotho; Helmut Niedrich, Gütersloh, both of Fed. Rep. of Germany

[73] Assignee: Durkoppwerke GmbH, Bielefeld, Fed. Rep. of Germany

[21] Appl. No.: 326,193

[22] Filed: Dec. 1, 1981

[30] Foreign Application Priority Data

Dec. 2, 1980 [DE] Fed. Rep. of Germany ..... 8032048

[51] Int. Cl.[3] ..... D05B 21/00

[52] U.S. Cl. ..... 112/121.15; 112/121.26; 112/153

[58] Field of Search ..... 112/121.26, 121.27, 112/121.12, 121.15, 136, 153

[56] References Cited

U.S. PATENT DOCUMENTS

| | | | |
|---|---|---|---|
| 4,013,025 | 3/1977 | Marforio | 112/121.15 |
| 4,062,309 | 12/1977 | Pollmeier et al. | 112/121.26 X |
| 4,066,027 | 1/1978 | Marforio | 112/121.15 |
| 4,104,977 | 8/1978 | Pollmeier et al. | 112/153 X |
| 4,315,470 | 2/1982 | Torre et al. | 112/121.15 |

*Primary Examiner*—H. Hampton Hunter
*Attorney, Agent, or Firm*—Karl F. Ross

[57] ABSTRACT

A thread guide is used in combination with a standard sewing machine having a work table and a fabric feed for displacing a workpiece to be sewn on the table in a predetermined forward longitudinal direction through a sewing station on the table. The fabric guide comprises a transversely elastically deformable band extending generally in the workpiece-displacement direction and oriented on edge and holders engaging the band at a plurality of longitudinally offset locations for securing the band on the table with each of the locations in any of a multiplicity of transversely offset positions. Thus the band can be deformed into and held in a nonstraight shape. The guide further has a carriage displaceable on the table along the guide and provided with a clip fastenable on the workpiece, and a counterweight urging the carriage and clip longitudinally in a backward longitudinal direction opposite the forward longitudinal direction. The band is a ribbon of flexible spring steel that is longitudinally substantially inextensible and that is only deformable transversely to its plane.

10 Claims, 2 Drawing Figures

WORKPIECE GUIDE FOR AUTOMATIC SEWING MACHINE

FIELD OF THE INVENTION

The present invention relates to a workpiece guide for an automatic sewing machne. More particularly this invention concerns such a guide used to hold the workpiece tight upstream of the sewing station and to displace the workpiece laterally as it is being sewn to form a nonstraight seam.

BACKGROUND OF THE INVENTION

An automatic sewing machine has a work table and a fabric feed for displacing a workpiece to be sewn in a predetermined forward longitudinal direction through a sewing station on the table. It is known from U.S. Pat. No. 4,066,027 to guide and tension the fabric workpiece by attaching to its trailing end a clip carried on a carriage that can move along a straight rail. This rail in turn is pivoted at its end closer to the sewing station an upright axis, so that the rail can be aimed to feed the goods at the desired angle to the needle. Normally about 10° of angular mobility is needed for the necessary adjustment to compensate for different needle styles and seam types.

The carriage is provided with biasing means for urging it and its clip longitudinally backward to keep the goods tensioned. It is standard to provide two such rails immediately adjacent each other, each with a respective clip carriage, so that one workpiece can be taken out and another loaded in on one carriage while the workpiece of the other carriage is being sewn.

This machine takes over two of the functions of a machine operator, that of holding together the layers of goods at the trailing end, and that of maintaining some tension on the goods to make a flat seam. The function of moving the goods transversely for a nonstraight seam is not and cannot be fulfilled by the known devices, which only serve for the automatic sewing of straight seams.

OBJECTS OF THE INVENTION

It is therefore an object of the present invention to provide an improved guide for a sewing machine.

Another object is the provision of such a guide for a sewing machine which overcomes the above-given disadvantages.

Yet another object is to provide such a guide which can be used for the production of nonstraight seams.

A further object is to provide a guide which can be set up to produce all types of curved seams.

SUMMARY OF THE INVENTION

These objects are attained according to the instant invention in a thread guide used in combination with a standard sewing machine having a work table and a fabric feed for displacing a workpiece to be sewn on the table in a predetermined forward longitudinal direction through a sewing station on the table. The fabric guide according to this invention comprises a transversely elastically deformable band extending generally in the workpiece-displacement direction and oriented on edge and holder means engaging the band at a plurality of longitudinally offset locations for securing the band on the table with each of the locations in any of a multiplicity of transversely offset positions. Thus the band can be deformed into and held in a nonstraight shape. The guide further has a carriage displaceable on the table along the guide and provided with a clip fastenable on the workpiece, and means urging the carriage and clip longitudinally in a backward longitudinal direction opposite the forward longitudinal direction.

The band according to this invention is a ribbon of flexible spring steel that is longitudinally substantially inextensible and that in fact is only deformable transversely to its plane. Such a band makes a very effective guide that can easily be bent into and held in any desired nonstraight shape, and that can when thus bent function as a guide rail for the carriage.

According to another feature of this invention, the holder means includes respective holders extending transverse to the direction and each having an inner end secured to the band at the respective location and an outer end, respective anchors at the outer ends securing same to the table, and respective means for varying the effective length of the holders between their respective ends and thereby varying the shape of the band. The more such holder means are provided the greater the possible variations in the shape that can be set in the band.

Each of the holders according to the invention is provided at the respective inner end with a pivot defining an inner vertical pivot axis between the inner end and the band at the respective location. To this end the band is provided at each of the locations with a pivot block pivoted on the respective inner end about the respective inner axis.

The anchors in accordance with the invention each include a lower base part secured to the table and an upper clamp pivotal relative to the respective lower base part about a respective outer vertical axis. The clamps in turn each include a lower clamp part, an upper clamp part forming with the respective lower part a passage in which the respective outer end is receivable and transversely displaceable, and means for urging the upper parts down against the respective lower parts and for thereby clamping the respective holder.

The holders according to this invention are simply rods and the means for urging includes a vertical screw centered on the respective outer axis and threaded into the respective lower part, the clamps being pivotal about the respective screws in the loosened condition of same.

According to another feature of this invention, the upper and lower clamp parts are respectively formed with downwardly and upwardly open alignable grooves forming the respective passages. In addition the anchors include a rail secured to the table, extending generally parallel to the directions, and carrying the bases. This rail in turn is provided with means for releasably securing itself to the table.

DESCRIPTION OF THE DRAWING

The above and other features and advantages will become more readily apparent from the following, reference being made to the accompanying drawing in which.

SPECIFIC DESCRIPTION

Figure 1:
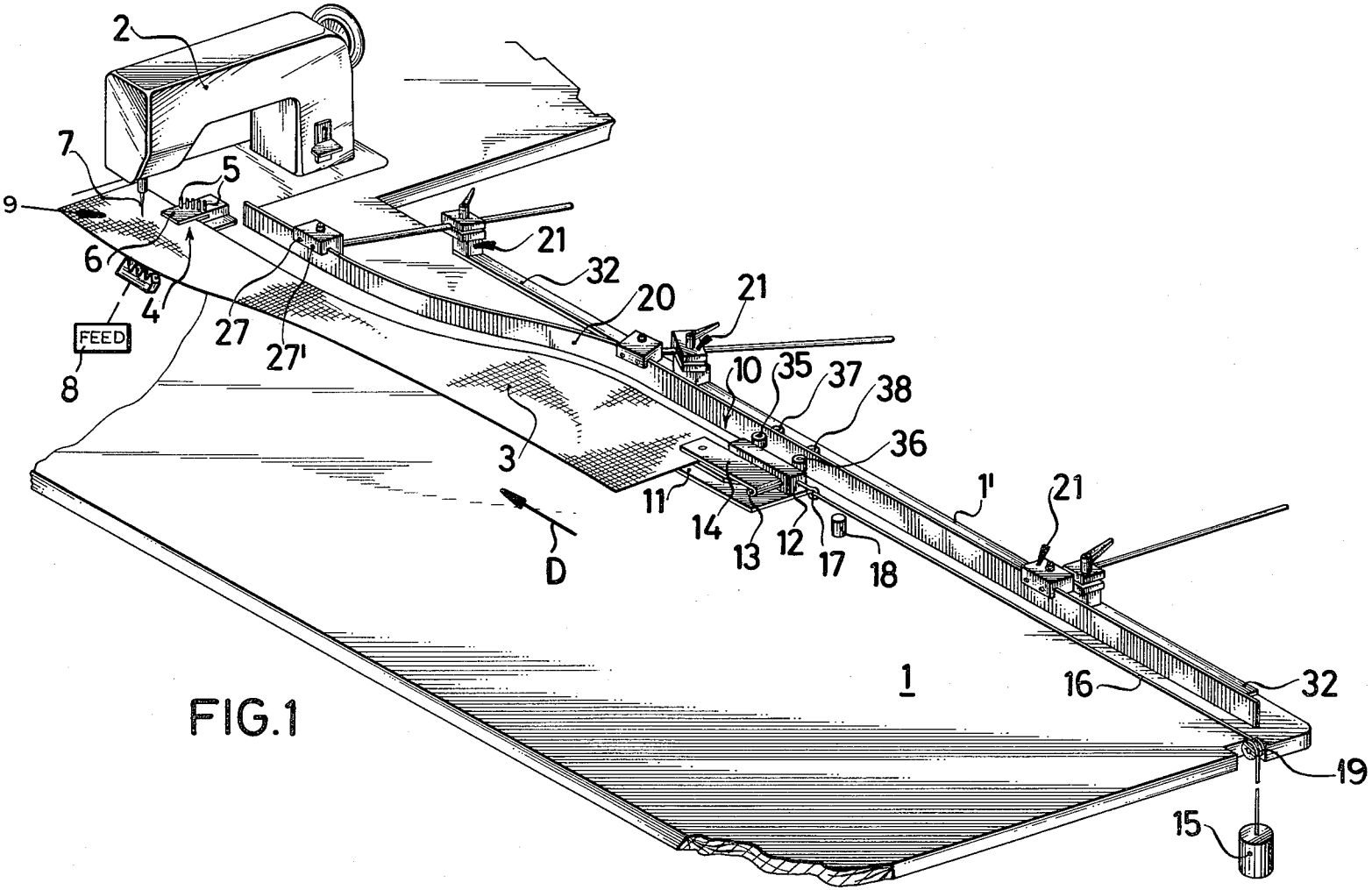
FIG. 1 is a partially schematic perspective view of a sewing machine equipped with a guide according to this invention.

As seen in FIG. 1 a horizontal work table 1 is provided with a standard automatic sewing machine 2 adapted to stitch a multilayer workpiece 3 moved through it in a forward longitudinal direction D. A feed 8 is provided underneath the sewing machine 2 at a sewing station 9. This feed may be of the type described in commonly owned U.S. Pat. application No. 235,537 filed Feb. 18, 1981.

The sewing station has a vertically reciprocal needle 7 and an edge guide 4 of the type having five pins 5 as described in commonly owned U.S. Pat. No. 4,227,471 and in German utility model 7,330,505 cited therein. A transversely effective jet of compressed air may assist in holding the workpiece 3 in the guide 4. In addition an electric-eye arrangement may be provided to start and stop the sewing machine 2.

The trailing end of the workpiece 3 is held in a drag-type clamp 10 formed as a carriage having a base plate 11 provided with a support block 12 on which a clip element 4 is pivoted about a horizontal pin 13 extending perpendicular to the direction D. A spring or pneumatic arrangement such as described in commonly owned U.S. Pat. No. 4,258,637 is provided to grip or otherwise catch the trailing workpiece end. A cable 16 is attached at one end to an eye 17 on the rear end of the block 12 and at its other end to a pendant weight 15 to urge the clamp 10 backward against the direction D, an idler wheel 19 being provided at the table edge for the cable 16. A stop button 18 on the table 1 limits the travel of the clamp 10 and may coact with the clamp 10 in the manner described in commonly owned U.S. Pat. No. 4,258,637. In addition the block 12 carries two longitudinally spaced left-hand rollers 35 and 36 and respective longitudinally spaced right-hand rollers 37 and 38.

Figure 2:
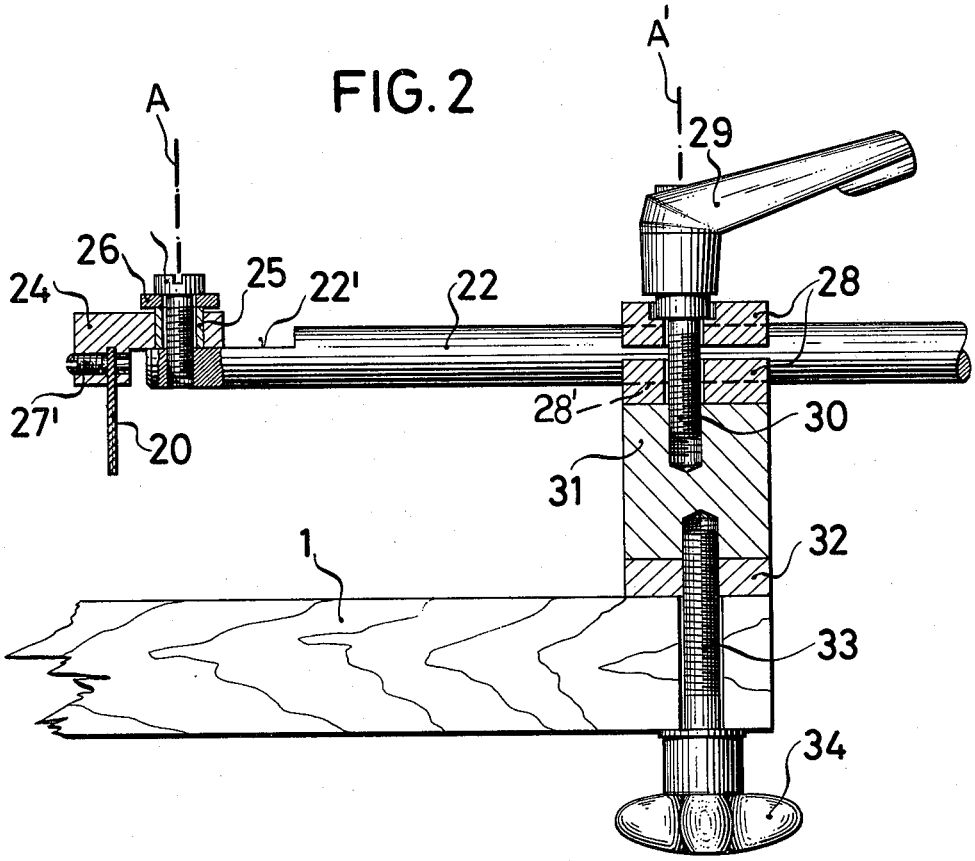
FIG. 2 is alarge-scale section taken through one of the holders according to this invention.

The clamp 10 can move along a rail 20 also shown in FIG. 2 and formed of a thin spring-steel band oriented on edge and held in a nonstraight curved shape by means of three holders 21. Each such holder 21 comprises a cylinrical rod 22 formed at its inner end with an upwardly directed flat 22' on which flatly engages a small block 24 secured by screws 27 and 27' (see FIG. 1) to the respective location on the band 20. A screw 23 passes through a sleeve 26 passing in turn through a vertically throughgoing bore 25 formed in the block 24 and is threaded into the inner end at the flat 22'. Thus the block 24 and associated portion of the band 20 can pivot freely about a vertical axis A relative to the holder arm or rod 22.

The outer end of the holder rod 22 is gripped in a cylindrical passage formed between two confronting grooves 28' of two clamp parts 28. These parts 28 sit atop a mounting block 31 screwed to a rail 32 secured by a screw 33 having a knob head 34 to the table 1. The rail 32 extends parallel to the direction D and is releasably secured to the right-hand edge of the table 1. A screw 30 having a handle 29 and centered on an upright axis A' passes through the two parts 28 adjacent the grooves 28' and is screwed into the block 31 so that the parts 28 can rotate on the block 31 about the upright axis A', and also can be clamped in any angular position thereon.

Thus when the screw 30 is loosened the rod 22 can slide longitudinally along the axis A' between the parts 28 and its inner end can also be pivoted about the axis A' relative to its gripped outer end. Tightening of the screw 30 locks the rod 22 in position.

The block 24 is always pivotal about the axis A on the outer rod end so that the rail-forming band 20 will naturally form a smooth curve when bent as illustrated into a nonstraight shape.

With the system according to the instant invention, therefore, the clamp 10 will ride along the band 20, with its rollers 35 and 36 to one side of ths band 20 and its rollers 37 and 38 to the other, so that it will exactly follow the nonstraight shape set into the band 20 in the manner described above and will correspondingly laterally move the gripped workpiece 3 as same moves in the direction D. The system can relatively easily be set up to sew any type of nonstraight seam, such as a skirt seam, almost wholly automatically. The band 20 when properly clamped constitutes an extremely accurate guide rail that will not deform or change shape once properly clamped in place, but which can relatively easily be reshaped for a new nonstraight seam.

We claim:

1. In combination with a sewing machine having a work table and a fabric feed for displacing a workpiece to be sewn on said table in a predetermined forward longitudinal direction through a sewing station on said table, a fabric guide comprising:

a transversely elastically deformable band extending generally in said direction and oriented on edge;

holder means engaging said band at a plurality of longitudinally offset locations for securing said band on said table with each of said locations in any of a multiplicity of transversely offset positions, whereby said band can be deformed into and held in a nonstraight shape;

a carriage displaceable on said table along said guide and provided with a clip fastenable on said workpiece; and means urging said carriage and clip longitudinally in a backward longitudinal direction opposite said forward longitudinal direction.

2. The fabric guide defined in claim 1 wherein said holder means includes:

respective holders extending transverse to said direction and each having an inner end secured to said band at the respective location and an outer end;

respective anchors at said outer ends securing same to said table; and respective means for varying the effective length of said holders between their respective ends and thereby varying said shape of said band.

3. The fabric guide defined in claim 2 wherein each of said holders is provided at the respective inner end with a pivot defining a vertical inner pivot axis between said inner end and said band at the respective location.

4. The fabric guide defined in claim 3 wherein each of said anchors includes a lower base part secured to said table and an upper clamp pivotal relative to the respective lower base part about a respective outer vertical axis.

5. The fabric guide defined in claim 4 wherein said clamps each include:

a lower clamp part;

an upper clamp part forming with the respective lower part a passage in which the respective outer end is receivable and transversely displaceable; and means for urging said upper parts down against the respective lower parts and for thereby clamping the respective holder.

6. The fabric guide defined in claim 5 wherein said holders are rods.

7. The fabric guide defined in claim 5 wherein said means for urging includes a vertical screw centered on the respective outer axis and threaded into the respective lower part, said clamps being pivotal about the respective screws in the loosened condition of same.

8. The fabric guide defined in claim 5 wherein said upper and lower clamp parts are respectively formed with downwardly and upwardly open alignable grooves forming the respective passages.

9. The fabric guide defined in claim 5 wherein said anchors include a rail secured to said table, extending generally parallel to said directions, and carrying said bases.

10. The fabric guide defined in claim 9, further comprising means for releasably securing said rail to said table.

* * * * *